US006508360B1

(12) United States Patent
Chen

(10) Patent No.: US 6,508,360 B1
(45) Date of Patent: Jan. 21, 2003

(54) SOCKET SUSPENSION RACK

(76) Inventor: Kun-Chen Chen, No. 6, Lane 609, Chung-Shan Rd., Sec. 1, Ye-Her Li, Tachia Chen, Taichung Hsien (TW)

( * ) Notice: Subject to any disclaimer, the term of this patent is extended or adjusted under 35 U.S.C. 154(b) by 0 days.

(21) Appl. No.: 09/917,935

(22) Filed: Jul. 31, 2001

(51) Int. Cl.[7] ..... B65D 85/20

(52) U.S. Cl. ..... 206/378; 211/70.6; 206/493; 206/349

(58) Field of Search ..... 206/378, 377, 206/372, 493, 349; 211/70.6; 296/146, 162

(56) References Cited

U.S. PATENT DOCUMENTS 4,421,230 A * 12/1983 Stanton ..... 206/372
6,092,655 A * 7/2000 Ernst ..... 206/378
6,092,656 A * 7/2000 Ernst ..... 206/378
6,098,799 A * 8/2000 Lee ..... 206/350

* cited by examiner

*Primary Examiner*—David T. Fidei
(74) *Attorney, Agent, or Firm*—Bacon & Thomas, PLLC

(57) ABSTRACT

A socket suspension rack includes a U-shaped guard and a suspension rod attached to the guard to form a space to hold sockets. The suspension rod has multiple holders extending toward the guard to be received in a square hole in the socket to hold the socket in place. Each holder includes two resilient plates facing each other. A boss extends outwardly from the resilient plate and engages to a detent defined in the sidewall of the square hole in the socket. An inverted U-shaped strip is integrally formed between the two resilient plates to provide a restitution force to the two resilient plates to hold the socket in place and prevent the socket from detaching from the suspension rod.

4 Claims, 5 Drawing Sheets

SOCKET SUSPENSION RACK

BACKGROUND OF THE INVENTION

1. Field of the Invention

The present invention relates to a suspension rack, and more particularly to a socket suspension rack that can hold various size sockets on a suspension rod.

2. Description of Related Art

With reference to FIG. 5, a conventional socket suspension connector (60) in accordance with the prior art comprises a square socket stud (62) containing a cavity (63) and a holder (61) formed on the top of the socket stud (62). A ball (65) partially exposed outward from the socket stud (62) and a spring (64) pressing on the ball (65) to make the ball (65) extend outward are received in the cavity (63). A socket (not shown) can be mounted on the socket stud (62) with the ball (65) detachably received in the detent (not shown) inside the socket. The holder (61) is secured on an elongated track (not shown), thereby attaching the socket suspension connector (60) together with the socket to the elongated track. However, the spring (64) and the ball (65) must be pressed into the cavity (63) after the socket stud (62) is formed by injection molding such that the assembly process of the socket suspension (60) is complicated, thereby increasing the cost of manufacturing.

The present invention has arisen to mitigate and/or obviate the disadvantages of the conventional socket suspension rack.

SUMMARY OF THE INVENTION

The main objective of the present invention is to provide an improved socket suspension rack that can hold various size sockets on a suspension rod. To achieve the objective, the socket suspension rack in accordance with the present invention includes a U-shaped guard and a suspension rod attached to the guard to form a space to hold sockets. The suspension rod has multiple holders extending toward the guard to be inserted into a square hole in the socket to hold the socket in place. Each holder includes two resilient plates facing each other. A boss extends outwardly from each resilient plate and engages to a detent defined in the sidewall of the square hole in the socket. An inverted Q-shaped strip is integrally formed between the two resilient plates to provide a restitution force to the two resilient plates to hold the socket in place and prevent the socket from detaching from the suspension rod.

Further benefits and advantages of the present invention will become apparent after a careful reading of the detailed description with appropriate reference to the accompanying drawings.

DETAILED DESCRIPTION OF THE INVENTION

Figure 1:
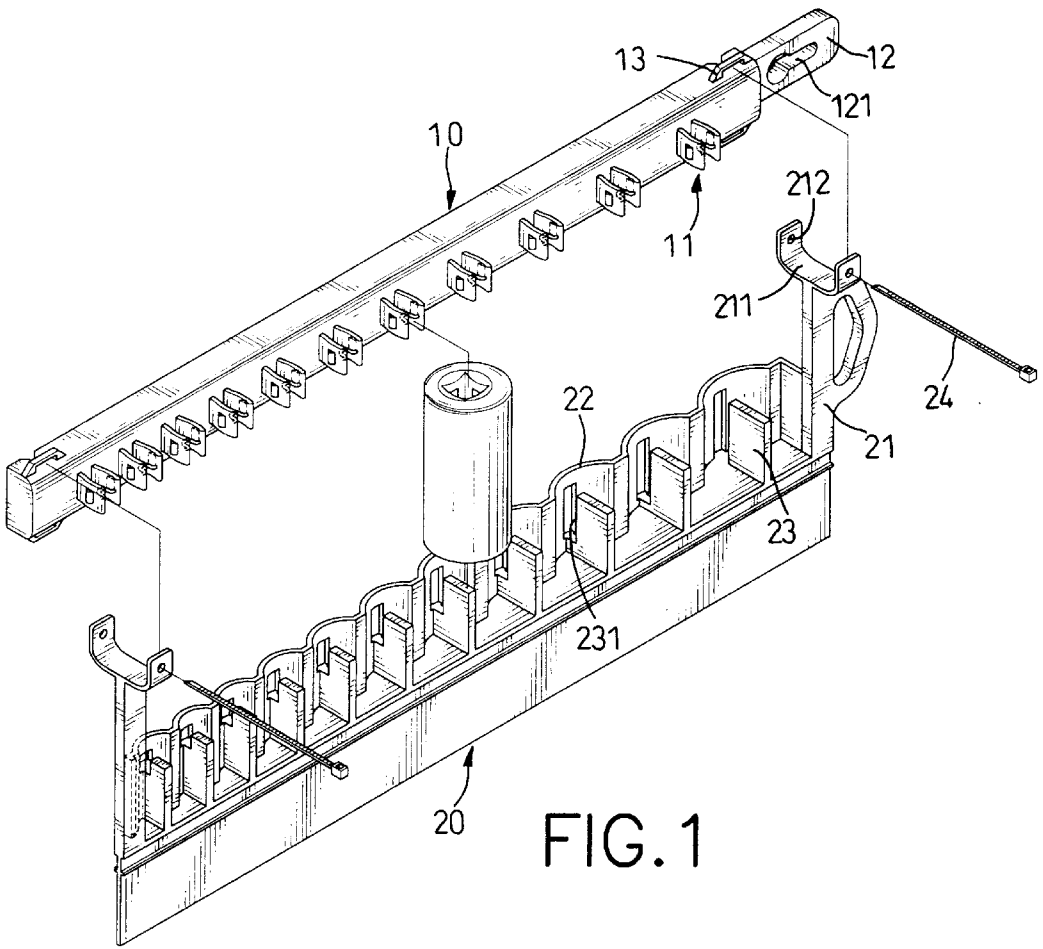
FIG. 1 is an exploded perspective view of a socket suspension rack in accordance with the present invention.
Figure 2:
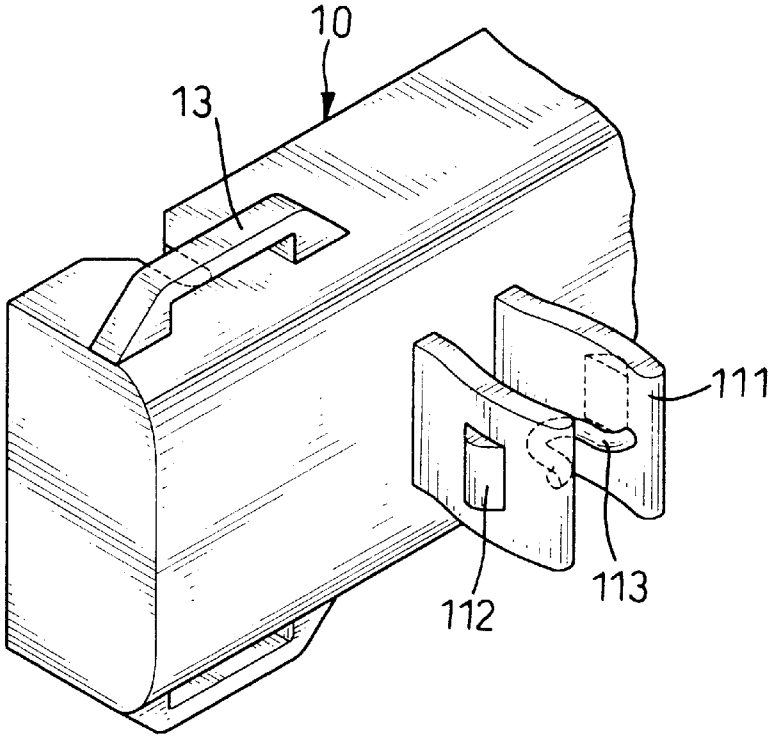
FIG. 2 is an enlarged perspective view of the suspension rod in FIG. 1.
Figure 4:
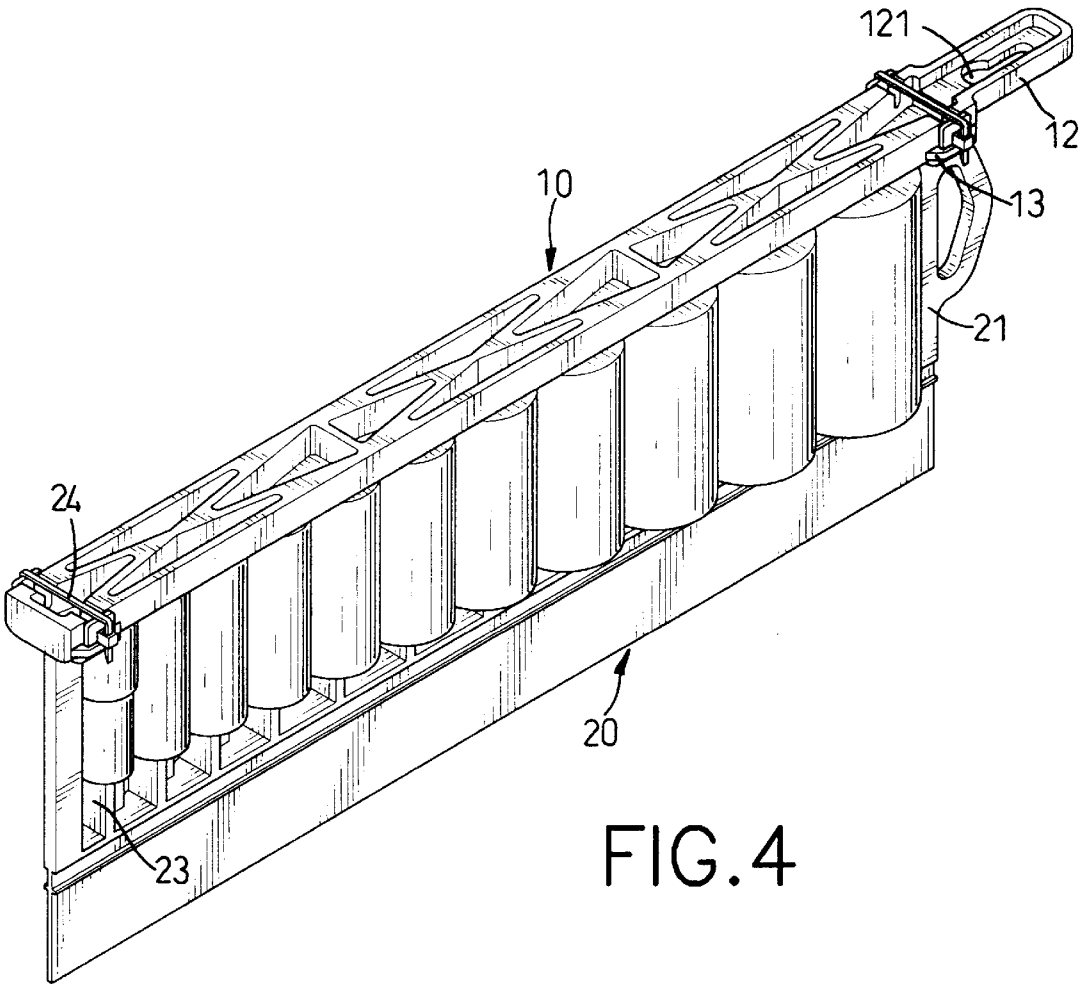
FIG. 4 is a perspective view of the socket suspension rack in FIG. 1.
Figure 5:
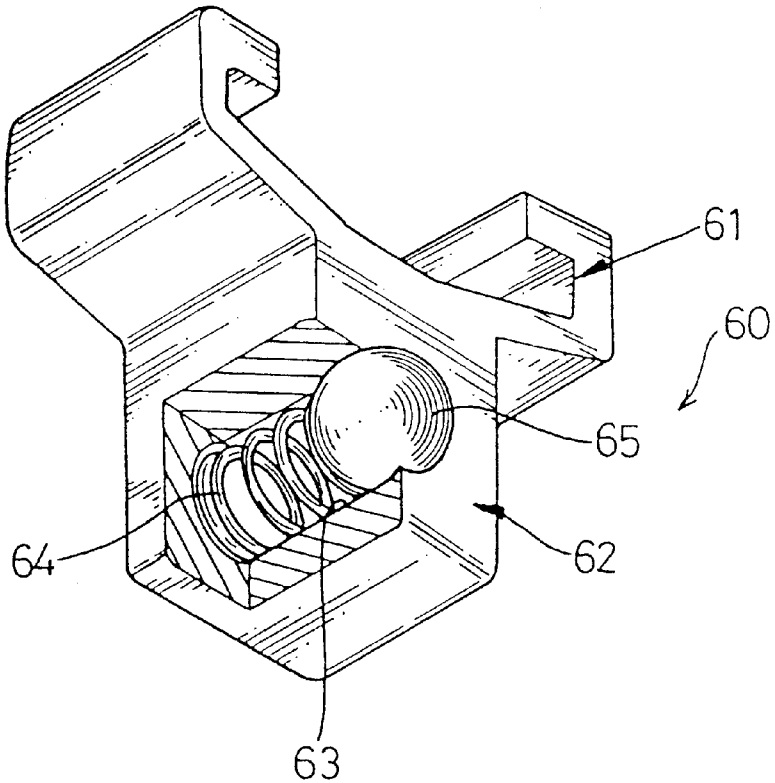
FIG.5 PRIOR ART
FIG. 5 is a perspective view of a conventional socket connector in accordance with the prior art.

With reference to the drawings and initially to FIGS. 1, 2 and 4, a socket suspension rack in accordance with the present invention comprises a suspension rod (10) and a U-shaped guard (20) detachably attached to the suspension rod (10) to form a space to hold sockets.

The suspension rod (10) has a top, bottom, front side, rear side and two ends and includes multiple holders (11) extending toward the guard (20) from the bottom of the suspension rod (10). Each holder (11) includes a pair of resilient plates ( 111) extending from the bottom of the suspension rod (10) with the individual resilient plates (111) in each pair facing each other. Each of the resilient plates (111) has a boss (112) laterally extending from each of the two resilient plates (111). The two bosses (112) on each holder (11) face away from each other. Opposite ends of an Ω-shaped strip (113) are integrally connected to a corresponding inner wall of the two resilient plate (111) to supply a restitution force to the two resilient plates (111). Two ears (13) laterally extend from each side of the suspension rod (10) near opposite ends of the suspension rod (10). A transverse groove is formed in the top of the suspension rod (10) between each pair of ears (13). A protrusion (12) extends longitudinally from one end of the suspension rod (10) and has a through hole (121) defined in the protrusion (12) to hang the present invention on an object, such as a wall.

The U-shaped guard (20) has two rods (21) respectively extending toward the suspension rod (10) from two opposite ends of the guard (20). A U-shaped bracket (211) is formed on a free end of the rod (21) and has two side plates (not numbered) with a through hole (212) defined in each side plate of the bracket (211). The side plates of a bracket (211) extend through the corresponding pair of ears (13) on the suspension rod (10). The through holes (212) in the bracket (211) are above the top of the suspension rod (10) when the suspension rod (10) is fully seated in the bracket (211). To secure the suspension rod (10) to the guard (20), a binding strip (24) inserted through the through holes (212) in the bracket (211) and fastened to itself to hold the suspension rod (10) and the guard (20) together. Then the sockets held between the suspension rod (10) and the guard (20) will not detached from the socket suspension rack to prevent the sockets from being stolen when they are on display.

Figure 3:
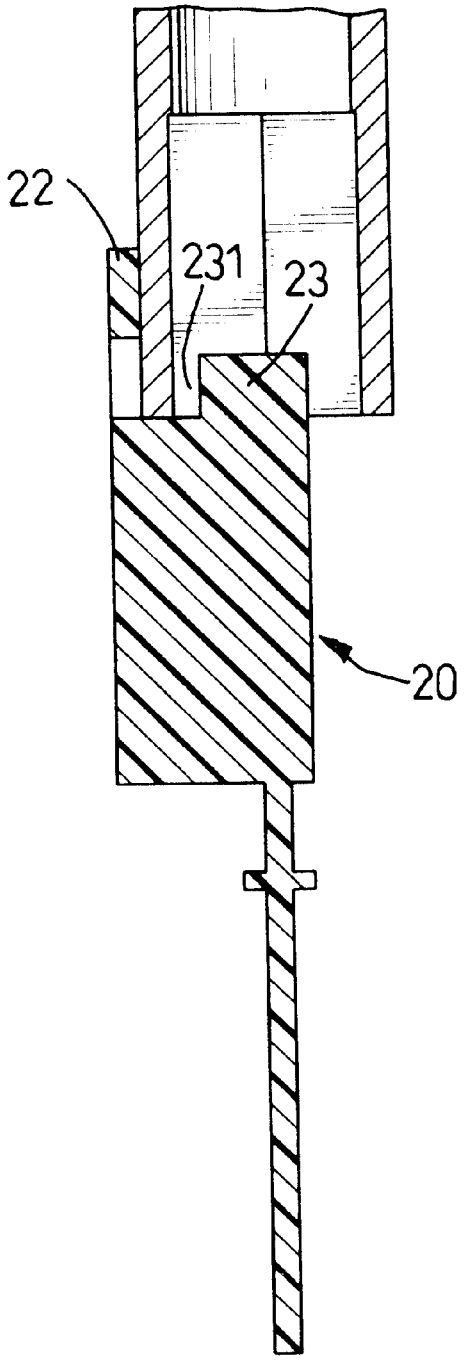
FIG. 3 is an enlarged cross sectional side plan view of the guard in FIG. 1.

With reference to FIGS. 1 and 3, a wave-shaped protecting plate (22) extends from a bottom of the guard (20) toward the suspension rod (10) and has multiple arcs each aligning with a corresponding one of the holders (11). Each of the arcs has a diameter progressively smaller from one end of the guard (20) to the other. Multiple positioning plates (23) extend perpendicularly from the bottom of the guard (20) toward the suspension rod (10). Each of the positioning plates (23) corresponds to a center of each of the arcs of the protecting plate (22). Each of the positioning plate (23) has a width progressively smaller relative to the diameter of the arc of the protecting plate (22). A channel (231) is defined in one side of the positioning plate (23) near the arc of the protecting plate (22). Each of the channels (231) has a depth progressively less relative to the diameter of the arc of the protecting plate (22).

With reference to FIGS. 3 and 4, a working hole (not numbered) is defined in the socket (not numbered) to drive a bolt or the like and a square hole defined to connect to a holder (11). The positioning plate (23) is received in the working hole of the socket and the holder (11) is inserted into the square hole in the socket when the guard (20) is connected to the suspension rod (10) to hold the socket in place between the suspension rod (10) and the guard (20). Furthermore, the restitution force of the Ω-shaped strip (113) can prevent the socket from detaching from the suspension rod (10) when the guard is detached from the suspension rod (10). All the elements of the suspension rod (10) and the guard (20) are integrally made by injection molding so that the cost of manufacturing the socket suspension rack of the present invention is reduced.

Although the invention has been explained in relation to its preferred embodiment, it is to be understood that many other possible modifications and variations can be made without departing from the spirit and scope of the invention as hereinafter claimed.

What is claimed is:

1. A socket suspension rack comprising:

a suspension rod with a top, bottom, front side, rear side and two ends including:

multiple holders extending from the bottom of the suspension rod, each holder having two resilient plates facing each other and each of the resilient plates having a boss extending out from the resilient plate;

a strip with two opposite ends respectively connected to an inner side of each resilient plate to provide a restitution force to the two resilient plates; and two ears formed on the front side and rear side of the suspension rod near each end of the suspension rod, the ears on the opposite side of the suspension rod aligning with each other; and a U-shaped guard connected to the suspension rod to form a space to hold sockets between the suspension rod and the guard, the U-shaped guard including:

two rods respectively extending from two opposite ends of the guard toward the suspension rod;

a U-shaped bracket formed on a free end of each rod to connect to the suspension rod and having side plate respectively extending through the ear formed on the opposite sides of the suspension rod;

a wave-shaped protecting plate extending from a bottom of the guard toward the suspension rod, the wave-shaped protecting plate having multiple arcs each aligning with a corresponding one of the holders, each arc of the wave-shaped protecting plate having a diameter progressively smaller from one end of the guard to the other;

multiple positioning plates perpendicularly extending from the bottom of the guard toward the suspension rod, each of the positioning plates corresponding to a center of each of arc of the protecting plate and having a width progressively smaller relative to the diameter of the arc of the protecting plate; and a channel defined in one side of each positioning plate near the arc of the protecting plate, each channel having a depth progressively less relative to the diameter of the arc of the protecting plate.

2. The socket suspension rack as claimed in claim 1, wherein the strip is Ω-shaped.

3. The socket suspension rack as claimed in claim 1, wherein the side plates of the bracket each has a bore defined to align with each other and above the top of the suspension rod, and the guard further comprises a binding strip extending through the bores in the side plates of the bracket, the binding strip fastening to itself to hold the suspension rod and the guard together.

4. The socket suspension rack as claimed in claim 2, wherein the side plates of the bracket each has a bore defined to align with each other and above the top of the suspension rod, and the guard further comprises a binding strip extending through the bores in the side plates of the bracket, the binding strip fastening to itself to hold the suspension rod and the guard together.

* * * * *